US005951140A

United States Patent [19]

Feldman

[11] Patent Number: 5,951,140

[45] Date of Patent: Sep. 14, 1999

[54] DISPLAY WITH FLEXIBLE ELECTROLUMINESCENT CONNECTOR

[75] Inventor: Harold Feldman, Flushing, N.Y.

[73] Assignee: Live Wire Enterprises, Inc., Brooklyn, N.Y.

[21] Appl. No.: 08/872,944

[22] Filed: Jun. 11, 1997

[51] Int. Cl.[6] ..... F21V 21/00

[52] U.S. Cl. ..... 362/84; 362/122; 362/806; 362/253; 362/382

[58] Field of Search ..... 362/84, 363, 122, 362/217, 806, 253, 223; 313/511, 512, 358

[56] References Cited

U.S. PATENT DOCUMENTS

| | | | |
|---|---|---|---|
| 1,515,053 | 11/1924 | Johnston | 362/122 |
| 1,530,229 | 3/1925 | Brown | 362/122 |
| 2,684,450 | 7/1954 | Meger et al. . | |
| 2,838,715 | 6/1958 | Payne . | |
| 3,052,812 | 9/1962 | Dow . | |
| 3,069,579 | 12/1962 | Berg et al. . | |
| 3,371,243 | 2/1968 | Bramley et al. . | |
| 3,571,647 | 3/1971 | Robinson . | |
| 3,792,308 | 2/1974 | Ota . | |
| 3,819,973 | 6/1974 | Hosford . | |
| 3,906,215 | 9/1975 | Dinicola | 362/122 |
| 4,020,389 | 4/1977 | Dickson et al. . | |
| 4,097,917 | 6/1978 | McCaslin | 362/84 |
| 4,812,952 | 3/1989 | Clemens | 362/84 |
| 4,855,190 | 8/1989 | Bezner | 428/690 |
| 4,910,647 | 3/1990 | Gong | 362/122 |
| 5,485,355 | 1/1996 | Voskoboinik | 362/84 |

FOREIGN PATENT DOCUMENTS

| | | |
|---|---|---|
| 3742412 | 6/1989 | Germany . |

*Primary Examiner*—Thomas M. Sember
*Attorney, Agent, or Firm*—Abelman, Frayne & Schwab

[57] ABSTRACT

A display unit, typically intended for placement on a table, includes a plurality of flexible elongated electroluminescent light sources connected to the individual display elements. The individual display elements may typically be balloons or flowers. The color emitted by the electroluminscent light source is dependant upon its particular electroluminophor powder. Hence, several different colored flexible elongated electroluminescent lights sources may be used within an individual display unit. The electroluminescent light source may extend into the balloon, such that it will exhibit a change of color between that portion within the balloon and outside of the balloon.

9 Claims, 2 Drawing Sheets

FIG. 3
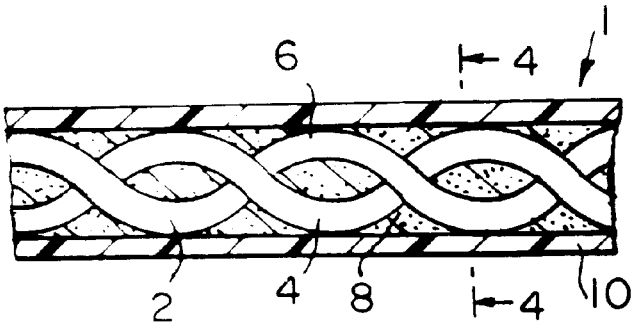
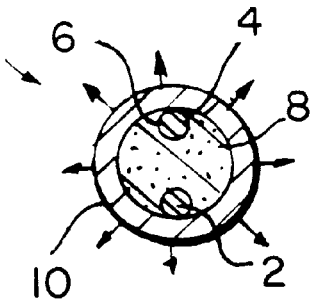
FIG. 4
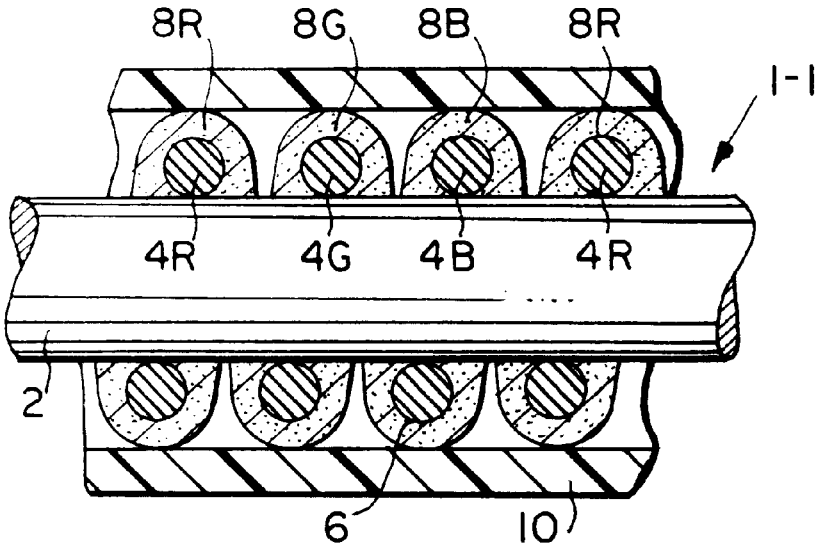
FIG. 5

DISPLAY WITH FLEXIBLE ELECTROLUMINESCENT CONNECTOR

FIELD OF THE INVENTION

The present invention relates to a display unit which includes at least one flexible elongated electroluminescent light source connected to an aesthetic display element, which may typically be a balloon or floral presentation. Should the display unit include a plurality of such flexible elongated electroluminescent light sources connected to a plurality of aesthetic display elements, the electroluminescent light sources may preferably be of different colors to enhance the overall visual effect.

BACKGROUND OF THE INVENTION

It is well known to provide a display unit, such as a centerpiece at banquets or other social functions, which includes individual aesthetic display elements, such as balloons or flowers. The individual aesthetic display elements are typically connected to a central base by strings, wooden sticks, wires, or a combination of such connecting elements.

In order to enhance the visual attractiveness of such display elements, it is also known to add thereto various lights, such as individual monochromatic bulbs which may offer either a steady or a flashing light.

While the display art has generally appreciated both the need to connect the various individual display elements to the base, and the desirability of providing lights as part of the display unit, it is not heretofore been known to utilize an attractive light source as the connecting element between the base and the individual aesthetic elements.

SUMMARY OF THE INVENTION

The present invention provides a display unit in which the individual aesthetic display elements (e.g., balloons and/or flowers) may be connected to the base of the display unit by flexible elongated electroluminescent light sources. Typically, such flexible elongated electroluminescent light sources may be of the type which is the subject of U.S. Pat. No. 5,485,355. As shown therein, the electroluminescent light source includes at least one pair of electrodes in proximity to electroluminophor powder and encased in a flexible transparent polyvinylchloride outer covering. The color of the light emitted by the light source, when appropriately energized, depends essentially on the type of electroluminophor powder used. Hence, a single display may include a multiplicity of different colored electroluminescent light sources to enhance its attractiveness and interest.

As a further feature of the present display, when used in conjunction with balloons or other colored transluscent aesthetic display elements, the electroluminescent light source may extend into the balloon. This may provide a change in color at the juncture of the electroluminescent light source which extends into, and out of, the balloon. For example, should the electroluminescent light source emit a yellow color, and extend into a blue balloon, the portion which extends into the balloon will be viewed as a green light.

Where the electroluminescent wire is also used in conjunction with floral members, it may, depending upon the structure of the flowers, either be wound directly about the stem portion of the flower which is inserted into the base unit, or about a secondary support member used in conjunction with the floral portion of the display.

Accordingly, a primary object of the present invention is to provide a display unit which includes a colored flexible elongated electroluminescent light source between the base of the display and the individual aesthetic display elements forming the display unit.

A further object of the present invention is to provide such a display unit which includes a plurality of electroluminescent light sources in different colors.

Still another object of the present invention is to provide such a display unit which includes balloons, with the flexible elongated electroluminescent light source extending into the balloon and changing the visible color at the balloon juncture.

These, as well as other objects of the present invention, will become apparent upon a description of the following drawings in which:

BRIEF DESCRIPTION OF DRAWINGS

FIGS. 3. and 4. show one form of a flexible elongated electroluminescent light source which may be used in conjunction with the display unit of FIGS. 1. and 2.

FIG. 5. shows an alternative form of a flexible electroluminescent light source which may be used in conjunction with the display of FIGS. 1. and 2.

DETAILED DESCRIPTION

Figure 1:
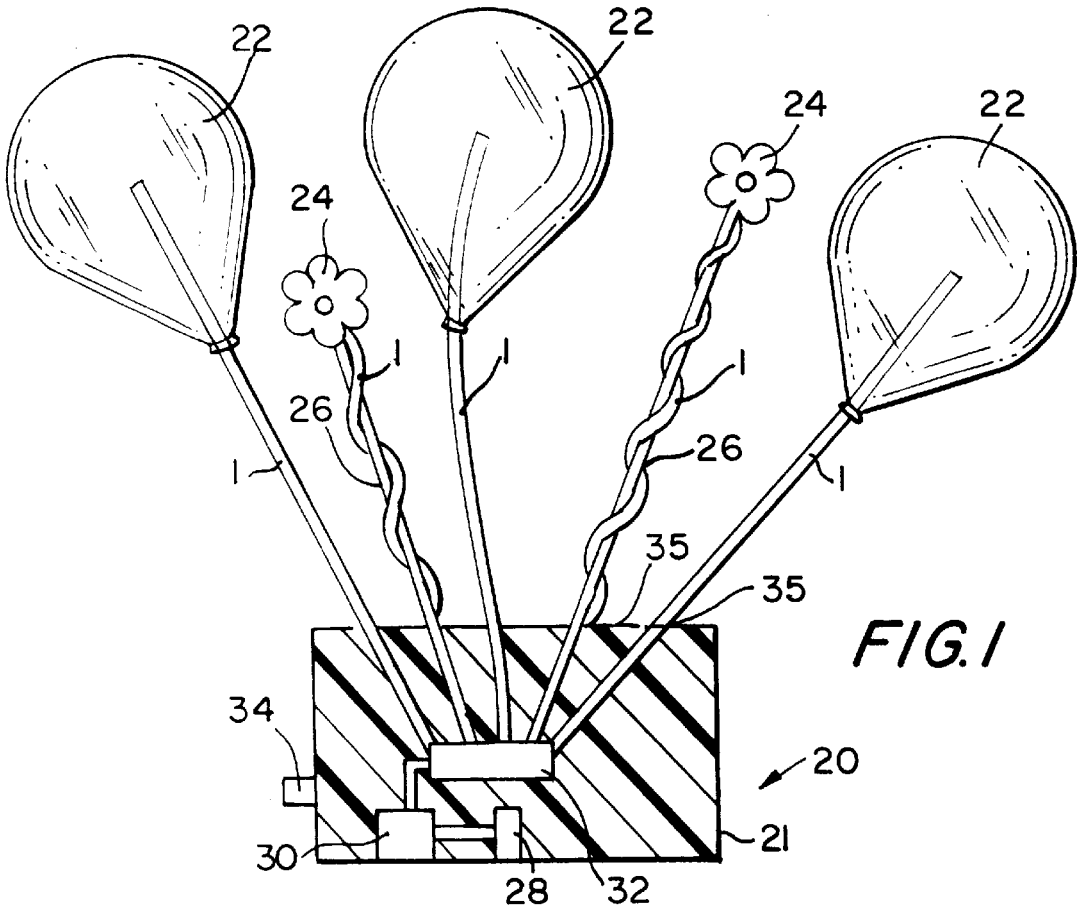
FIG. 1. is a general representation of one form of a display unit in accordance with the present invention.
Figure 2:
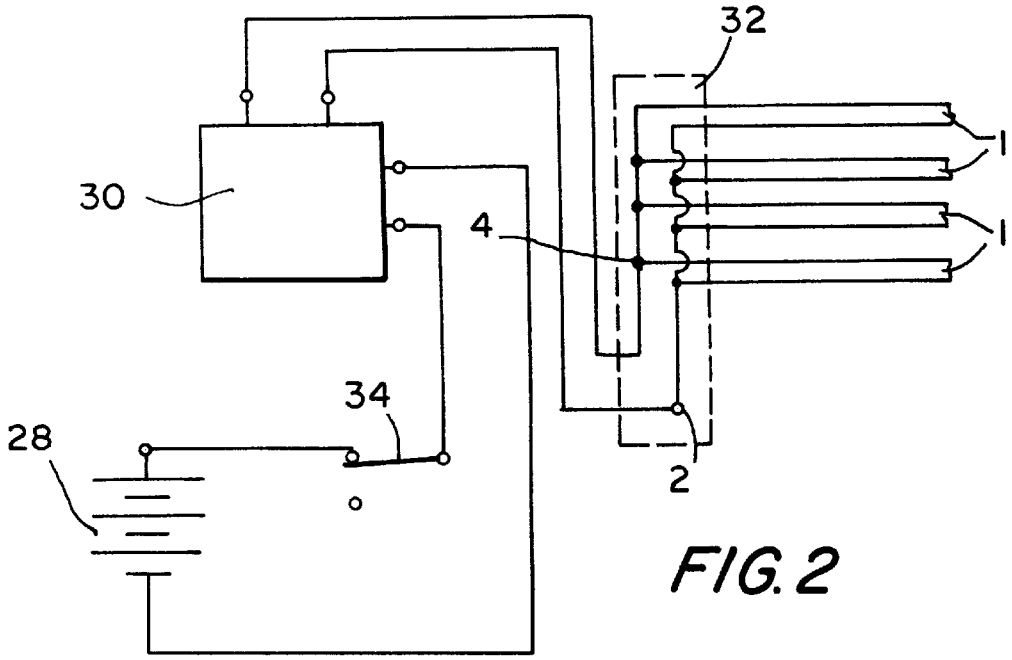
FIG. 2. shows the circuitry which may typically be used with respect to the display unit in FIG. 1.

Reference is initially made to FIGS. 1. and 2. which shows a typical display unit, and the electrical circuitry therefore, in accordance with the present invention. The display unit 20 is encased within a housing 21 which will typically be formed of steel or plastic and includes a plurality of openings 35 for passage of the electroluminescent light sources 1. (In some instances several such electroluminescent light sources, if desired, may pass through a single opening 35.) Electroluminescent light sources 1 may be of the type shown in U.S. Pat. No. 5,485,355, with two such forms thereof being shown in FIGS. 3.–5.

The plurality of electroluminescent light sources 1 are connected to the individual aesthetic display elements 22 and 24. The display elements 22 are shown as balloons. It should, however, be understood that other transparent or translucent balls or similar objects may also be used. The aesthetic display elements 24 are shown as flowers. Although a single flower is shown in association with each electroluminescent light source 1, this is for purposes of simplicity, with it being understood that individual floral arrangements may be provided in conjunction with each individual electroluminescent light source 1. Each of the aesthetic display elements including the flowers 24 are shown in conjunction with stick-like member 26. These are typical elements used in the florist trade for supporting one or more flowers in floral arrangements. However, where the stem of an individual flower is sufficiently strong, it may be utilized within the display unit 20 without the additional stick member 25.

Referring to FIGS. 3. and 4, the flexible, elongated electroluminescent light source 1. includes a twisted pair of electrodes 2. and 4. typically made of copper wire which may be in the order of 0.1–0.3 mm in diameter. The copper wire is covered with a layer of insulating lacquer 26. The wires are twisted around each other, typically with a twisting pitch in the order of 8–10 turns per cm. The helical hollows formed between the twisted wires are formed with the electroluminescent material 8 which comprises electroluminophor powder dispersed in an epoxy resins. As is well known in the electroluminescent art, the color of the light emitted by electroluminescent source 1. depends essentially on the type of electroluminophor powder used. In order to add increased diversity and interest to the display unit 20, electroluminescent wires 1. of different colors may be used.

FIG. 5. shows an alternative electroluminescent light source 1-1 which may be used in conjunction with the display unit 20. Electroluminescent light source 1-1 is designed to produce polychromatic light. There are provided a central electrode 2, which may be a copper wire of 1–3 mm in diameter, as well as three copper wire electrodes 4R, 4G and 4B, with R standing for red, G for green, and B for blue. These electrodes may each be of a diameter of 0.1–0.2 mm and are coated with an insulating layer of lacquer 6. On top of these lacquer layers, the electrodes 4R, 4G and 4B may be coated with 0.1–0.2 mm-thick layers of electroluminescent material 8R, 8G and 8B (for emitting red, green and blue light), respectively. They are then wound, preferably in a triple helix, around the central electrode 2, with a typical clearance of 0.1–0.2 mm between adjacent coats. The structure is then fully encased in a transparent polymer sheath 10.

To render structure 1-1 operative as a polychromatic source, AC voltages of a frequency preferably in the range of 50–20,000 Hz and of amplitudes preferably in the range of 100–300 V are applied between the central electrode 2 and any of the electrodes 4R, 4G or 4B. The powder particles in the respective electroluminescent materials 8R, 8G or 8B, when subjected to an alternating electric field, will emit red, green, or blue light respectively. The light exits through the clearances between the turns and through the transparent sheath 10 in such a way that the whole structure seems to emit the light of this color. If electrodes 4R, 4G and 4B are electrically connected together and the voltage applied between them and electrode 2, then each of the layers 8*r;* 8G and 8B will emit light of its own color, and the eye will perceive the combined color emitted by the light source as a whole to be substantially white. If different AC voltages of the above frequency and amplitude range are applied between electrode 2 and each of the electrodes 4R, 4G and 4B, the light source may emit any color depending on the frequency and amplitude of the voltage applied to each of the electrodes 4R, 4G, 4B. Thus, one can control and continuously change the color (hue, saturation and brightness) of the light emitted by the source, by adjusting the amplitudes or frequencies of the voltages on the electrodes. Switching between colors discontinuously may be achieved by discrete voltage changes.

Accordingly, a variety of aesthetically attractive and interesting light effects may be achieved by utilizing the particular flexible elongated electroluminescent light source in conjunction with a myriad of individual aesthetic display elements to provide a display unit.

While preferred embodiments of the present invention have been described in detail, various modifications, alterations and changes may be made without departing from the spirit and scope of the present invention as defined in the following claims.

What is claimed is:

1. A display unit comprising:

a base including a voltage source;

at least one connector formed of a flexible, elongated, electroluminescent light source, said connector having first and second ends, said first end inserted within said base and operatively connected to said voltage source, and said second end extending outward of said base, and an aesthetic display element connected to said second end.

2. A display unit according to claim 1, wherein said aesthetic display element is a balloon.

3. A display unit according to claim 1, wherein the second end of said electroluminescent light source extends into said balloon, said electroluminescent light source emits light of a first color, said balloon is of a second color, and the portion of the electroluminescent light source within said balloon as viewed from outside of said balloon is of a third color.

4. A display unit according to claim 3, including a plurality of electroluminescent connectors of at least two different colors extending outward of said base and extending into balloons of at least two different colors.

5. A display unit according to claim 4, wherein at least one of said electroluminescent connectors is a polychromatic light source.

6. A display unit according to claim 4, wherein said voltage source is a battery.

7. A display unit according to claim 3, further including flowers extending outward of said base.

8. A display unit according to claim 1, including a plurality of electroluminescent connectors of at least two different colors extending outward of said base.

9. A display unit according to claim 8, wherein at least one of said electroluminescent connectors is a polychromatic light source.

* * * * *